United States Patent [19]

Marte

[11] Patent Number: 4,915,242

[45] Date of Patent: Apr. 10, 1990

[54] DISPENSING INSERT FOR DISPENSING SOLID OR LIQUID MATERIAL FROM A BABY BOTTLE

[76] Inventor: Frank W. Marte, 54 Four Leaf Rd., Levittown, Pa. 19058

[21] Appl. No.: 402,476

[22] Filed: Sep. 5, 1989

[51] Int. Cl.[4] ..... A61J 9/00

[52] U.S. Cl. ..... 215/11.1; 215/DIG. 8; 604/77

[58] Field of Search ..... 222/94, 145, 129, 416, 222/490; 215/11.1, 11.5, 11.6, 100 R, 228, DIG. 3, DIG. 8; 128/359, 360; 604/77, 79, 82, 83, 85

[56] References Cited

U.S. PATENT DOCUMENTS

| | | | |
|---|---|---|---|
| 1,336,366 | 4/1920 | Marsh | 215/11.1 |
| 2,612,165 | 9/1952 | Szuderski | 128/360 |
| 2,680,441 | 6/1954 | Krammer | 215/11.1 X |
| 2,968,414 | 1/1961 | Thomas | 215/11.1 |
| 2,984,377 | 5/1961 | Biondi | 215/11.1 |
| 3,077,279 | 2/1963 | Mitchell | 215/11.1 |
| 3,426,755 | 2/1969 | Clegg | 215/11.1 X |
| 3,645,413 | 2/1972 | Mitchell | 215/11.1 |
| 3,682,344 | 8/1972 | Lopez | 215/DIG. 8 X |
| 4,552,555 | 11/1985 | Theeuwes | 604/85 X |
| 4,754,887 | 7/1988 | Ou | 215/11.1 X |

FOREIGN PATENT DOCUMENTS

| | | | |
|---|---|---|---|
| 1124286 | 10/1956 | France | 215/11.1 |

*Primary Examiner*—Kevin P. Shaver

*Attorney, Agent, or Firm*—Z. T. Wobensmith, III

[57] ABSTRACT

A dispensing insert for use with a baby bottle for dispensing solid or liquid materials which insert fits between the bottle and the nipple cap. The insert having openings therethrough for communications with the material to be dispensed and the liquid in the bottle to permit of controlled dispensing of the material carried by the insert.

4 Claims, 1 Drawing Sheet

DISPENSING INSERT FOR DISPENSING SOLID OR LIQUID MATERIAL FROM A BABY BOTTLE

BACKGROUND OF THE INVENTION

Field of the Invention

This invention relates to a dispensing insert for use with a baby bottle and is of the type that fits between the nipple and the bottle.

DESCRIPTION OF THE PRIOR ART

In the dispensing of medicine, vitamins and the like to infants, problems often arise because the material has a strong or unpleasant taste which the infant comes to associate with dispensers, such as eyedroppers which are one of the most common means of administering liquid material. The use of eyedroppers is also not encouraged as they are usually glass and easily broken. Infants soon learn to resist, even if given by spoon which is awkward and the medicine is spilled. Various attachments have been provided for baby bottles such as is shown in the U.S. Pat. to Ballin, No. 3,468,445 and to Tweedale, No. 1,041,378, but none of them provides an acceptable solution.

The desirability of providing a sure, safe device to dispense medicine and the like to infants, with safety, and a minimum of disruption is a desirable goal.

Most all infants sooner or later are bottle fed, and the desirability of dispensing the material along with the infants milk or formula is recognized. It is also desirable to provide a dispenser that can come prepackaged so that the person doing the feeding does not have to measure out the material, but only has to insert the device into the baby bottle, and the material will be automatically dispensed while the infant is consuming the contents of the baby bottle.

While the material to be dispensed if in liquid form could be directly mixed with the milk, it is often desirable to use a solid form of material that dissolves over time, and by placing the material adjacent the nipple the flow of milk past and onto it assists in the dissolving.

The dispenser of the invention fulfills the desired objectives and provides many advantages not present in the prior art.

SUMMARY OF THE INVENTION

A dispenser for dispensing medicine and the like of both liquid and solid form, which includes an insert which has a chamber that contains the material to be dispensed and fits between the nipple and the bottle.

The principal object of the invention is to provide a dispenser for baby bottles that can be used to dispense a variety of material both in solid and liquid form.

A further object of the invention is to provide a dispenser of the character aforesaid which is easy to use.

A further object of the invention is to provide a dispenser of the character aforesaid which is simple and inexpensive to construct.

A further object of the invention is to provide a dispenser of the character aforesaid that is useful for single or multiple use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spriit of the invention.

Like numerals refer to like parts throughout the several views.

DESCRIPTION OF THE PREFERRED EMBODIMENT

Figure 1:
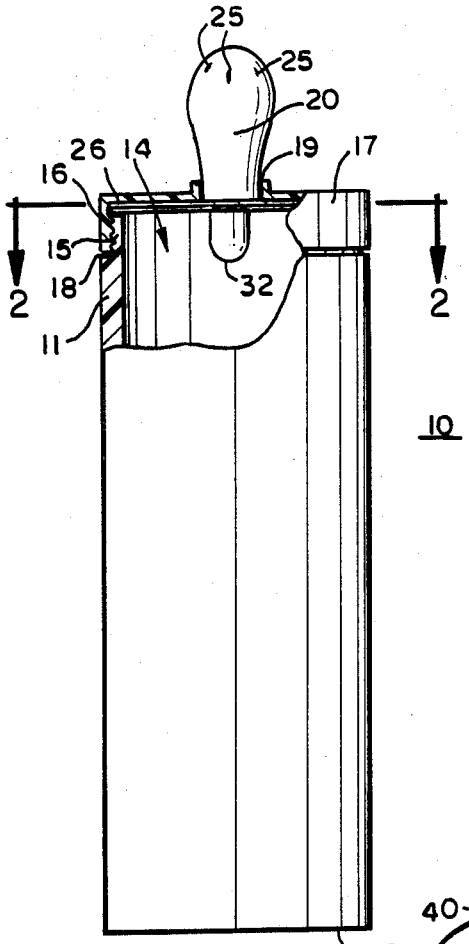
FIG. 1 is a side elevational view, in partial section, of a baby bottle which incorporates the dispenser of the invention.
Figure 2:
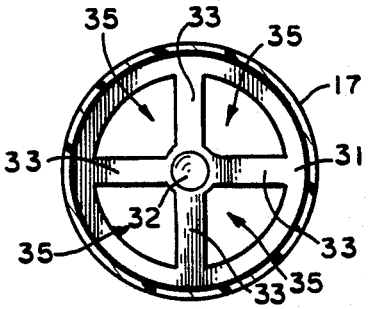
FIG. 2 is a horizontal sectional view, taken approximately on the line 2—2 of FIG. 1.

Referring now more particularly to the drawings and FIGS. 1 to 2 thereof, a baby bottle 10 is illustrated of conventional type, which is formed of plastic or glass. The bottle 10 is of hollow construction, with outer wall 11 closed off at end 12, with an opening 14 at the other end 15. The end 15 has a threaded portion 16, which has a cap 17, with threads 18 engaged therewith. The cap 17 may be formed of any suitable plastic, and has a central opening 19, which can receive a flexible nipple 20 of conventional type, which has a plurality of openings 25 to permit liquids (not shown) to be withdrawn. Nipple 20 at the bottom has a skirt 26 which is slightly smaller in diameter than the inside of cap 17 and with an opening (not shown) to permit liquid to flow into nipple 20 and out openings 25.

Figure 3:
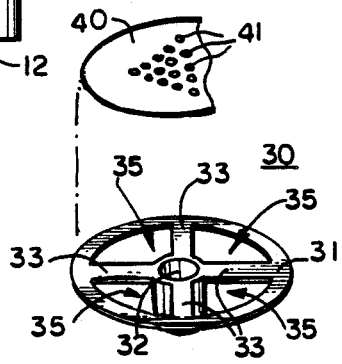
FIG. 3 is a view in perspective of the dispenser of the invention.

Referring now more particularly to FIG. 3, the dispenser 30 of the invention is illustrated in more detail. The dispenser 30 is of circular configuration with an outer circular flange 31, which is intended to go between the skirt 25 of nipple 20 and the wall 11 at end 15. The flange 11 has four inwardly extending spaced ribs 33 which are connected to a receptacle 32 for material (not shown) to be dispensed into the surrounding liquid (not shown) and out openings 25. The receptacle 32 is of thimble shape open at one end, and smaller in cross section than the opening (not shown) in nipple 20 to permit liquids to flow around the receptacle and out the openings (not shown), to be described. The dispenser 30 has openings 35 between the ribs 33 through which liquid flows out the opening (not shown) in nipple 20 and through openings 25. The dispenser 30 can be constructed of any suitable material, such as soft rubber, that is non-toxic and compatible with the materials to be dispensed. The receptacle can be fitted with a cover (not shown) that is solid and removed for dispensing or with cover 40 with perforations 41 for controlled release of liquid in the receptacle as required. The receptacle can have either liquid or solid material therein as required.

It will thus be seen that a dispenser has been provided with which the objects of the invention are achieved.

I claim:

1. In combination with a baby bottle for feeding liquids to babies which is of hollow construction, closed off at one end and open at the other end with a removable nipple and cap, a dispenser for dispensing material into said nipple and located between said nipple and said bottle open end which comprises an outer circular flange, a plurality of ribs extending inwardly from said flange, a centrally located receptacle connected to said ribs to receive material to be dispensed, and a plurality of openings between said ribs, said flange and said receptacle through which said liquids pass.

2. The combination as defined in claim 1 in which said dispenser receives one of a solid or a liquid material to be dispensed.

3. The combination as defined in claim 1 in which said dispenser is of soft rubber.

4. The combination as defined in claim 2 in which said dispenser receptacle has a perforated cover for controlled release of material to be dispensed.

* * * * *